US005154592A

United States Patent [19]

Ohtani et al.

[11] Patent Number: 5,154,592

[45] Date of Patent: Oct. 13, 1992

[54] SCROLL TYPE FLUID APPARATUS WITH ROTATION RESTRAINING MECHANISM

[75] Inventors: Iwao Ohtani, Tokyo; Takayuki Ando; Yoshifumi Fukuhara, both of Kanagawa, all of Japan

[73] Assignee: Tokico Ltd., Kanagawa, Japan

[21] Appl. No.: 598,413

[22] Filed: Oct. 18, 1990

[30] Foreign Application Priority Data

Oct. 20, 1989 [JP] Japan ..... 1-273251

[51] Int. Cl.[5] ..... F01C 1/04

[52] U.S. Cl. ..... 418/55.3

[58] Field of Search ..... 418/55.3

[56] References Cited

U.S. PATENT DOCUMENTS

| | | | |
|---|---|---|---|
| 3,802,809 | 4/1974 | Vulliez | 418/55.3 |
| 4,731,000 | 3/1988 | Haag | 418/55.3 |
| 4,861,245 | 8/1989 | Tojo et al. | 418/55.3 |

FOREIGN PATENT DOCUMENTS

| | | | |
|---|---|---|---|
| 270917 | 6/1988 | European Pat. Off. | 418/55.3 |
| 57-171002 | 10/1982 | Japan | 418/55.3 |
| 58-30402 | 2/1983 | Japan | 418/55.3 |
| 58-30403 | 2/1983 | Japan | 418/55.3 |
| 58-135302 | 8/1983 | Japan | 418/55.3 |
| 61-116001 | 6/1986 | Japan | 418/55.3 |

*Primary Examiner*—John J. Vrablik

*Attorney, Agent, or Firm*—Wenderoth, Lind & Ponack

[57] ABSTRACT

A scroll type fluid apparatus, such as a scroll vacuum pump or a scroll compressor, does not require lubrication by an external lubricating device. The scroll type fluid apparatus includes a casing, a stationary scroll member fixed to the casing, an orbiting scroll member cooperating with the stationary scroll member to form sealed chambers therebetween, and a restraining mechanism for restraining the orbiting scroll member from rotating about its own axis. The restraining mechanism employs prelubricated sealed bearings which support its component parts so that the component parts are in rolling contact with the corresponding portions of the orbiting scroll member, so that the component parts and the corresponding portions of the orbiting scroll member are not radially abraded, and portions of the scroll type fluid apparatus exposed to the fluid need not be lubricated by an external lubricating device.

8 Claims, 5 Drawing Sheets

SCROLL TYPE FLUID APPARATUS WITH ROTATION RESTRAINING MECHANISM

BACKGROUND OF THE INVENTION

1. Field of the Invention

The present invention relates to a scroll type fluid apparatus, such as an unlubricated scroll vacuum pump or an unlubricated scroll compressor.

2. Description of the Prior Art

Generally, a scroll type fluid apparatus comprises a casing, a fixed scroll member consisting of a mirror-finished plate fixed to the casing and a stationary lapping scroll standing upright on the plate, a drive shaft journalled on the casing and provided at its inner end, namely, one end located within the casing, with a crank, an orbiting scroll member consisting of a mirror-finished plate and a revolving scroll wrap formed so as to form a sealed space in combination with the stationary scroll wrap, and rotatably journalled on the crank of the drive shaft, and a restraining mechanism for restraining the orbiting scroll member from rotating about its own axis. When the scroll type fluid apparatus functions as an air compressor, air is sucked through a suction port formed near the outer end of the stationary scroll wrap into the compression chamber, i.e., the sealed space, the volume of the compression chamber is decreased gradually as the scroll member orbits to compress the air sucked into the compression chamber, and then the compressed air is discharged to the outside through a discharge port formed near the inner end of the stationary scroll wrap.

The orbiting scroll member must be restrained from rotating about its own axis to enable the orbiting scroll member to decrease the volume of the compression chamber formed between the stationary scroll wrap and the orbiting scroll wrap. The Oldham coupling is a well-known mechanism applicable for such a purpose. The Oldham coupling as applied to a scroll air compressor comprises an Oldham ring provided with an Oldham key seated in a keyway formed in the casing, and an Oldham key seated in a keyway formed in the reverse side of the plate of the orbiting scroll member.

When compressing air in a scroll air compressor provided with an Oldham coupling by moving the orbiting scroll member relative to the stationary scroll member, the air compressed in the compression chamber applies an axial load biasing the orbiting scroll member away from the stationary scroll member, namely, a thrust, to the orbiting scroll member, pressing the orbiting scroll member into close proximity with the Oldham coupling. Accordingly, the sliding surfaces of the orbiting scroll member and the casing engaging those of the Oldham coupling must be lubricated with a lubricating oil to ensure smooth movement of the orbiting scroll member and to prevent an abrasion of the associated parts.

On the other hand, when air is sucked into the compression chamber by the way of the orbiting scroll member, the air prevailing within the casing is sucked through minute gaps between the stationary scroll member and the orbiting scroll member into the compression chamber because a negative pressure is created within the compression chamber, entailing the flow of the mist of the lubricating oil together with the air into the compression chamber, so that the compressed air discharged by the scroll air compressor contains the lubricating oil.

Thus, the conventional scroll type fluid apparatus provided with an Oldham coupling requires the lubrication of the working surfaces of the component parts in sliding engagement, such as the Oldham coupling, the arbiting scroll member and the side wall of the casing, and needs an oil separator or the like to separate the lubricating oil from the compressed air before discharging the same, which makes the structure of the scroll type fluid apparatus complicated and increases the weight of the same.

Another known scroll type fluid apparatus employs a restraining mechanism employing an auxiliary crank disposed between the casing and the revolving scroll member and held onto the casing in a cantilever fashion. However, it is difficult for this scroll type fluid apparatus to secure a smooth revolving motion of the orbiting scroll member.

SUMMARY OF THE INVENTION

The present invention has been made in view of the foregoing problems in the conventional scroll type fluid apparatus, and it is therefore an object of the present invention to provide an unlubricated scroll type fluid apparatus having a compact structure.

To achieve this object, a scroll type fluid apparatus of the invention incorporates a restraining mechanism for restraining an orbiting scroll member from rotating about its own axis, comprising a plurality of guide means arranged at angular intervals along the circumference of the orbiting scroll member, a plurality of support shafts each axially penetrating the corresponding guide means with its axis offset from the center axis of the guide means by a predetermined distance and supported at its opposite ends on a casing, and a plurality of bearings each mounted on a corresponding support shaft and located in the guide means.

Supporting each of the support shafts of the restraining mechanism at their opposite ends on the casing ensures a stable movement of the orbiting scroll member, and the use of the bearings eliminates the necessity for lubricating of the orbiting scroll member and the associated parts by an external lubricating device.

BRIEF DESCRIPTION OF THE DRAWINGS

The above and other objects, features and advantages of the present invention will become more apparent from the following description taken in connection with the accompanying drawings in which.

DETAILED DESCRIPTION OF THE PREFERRED EMBODIMENTS

The present invention will be described in detail as applied to scroll compressors.

Figure 1:
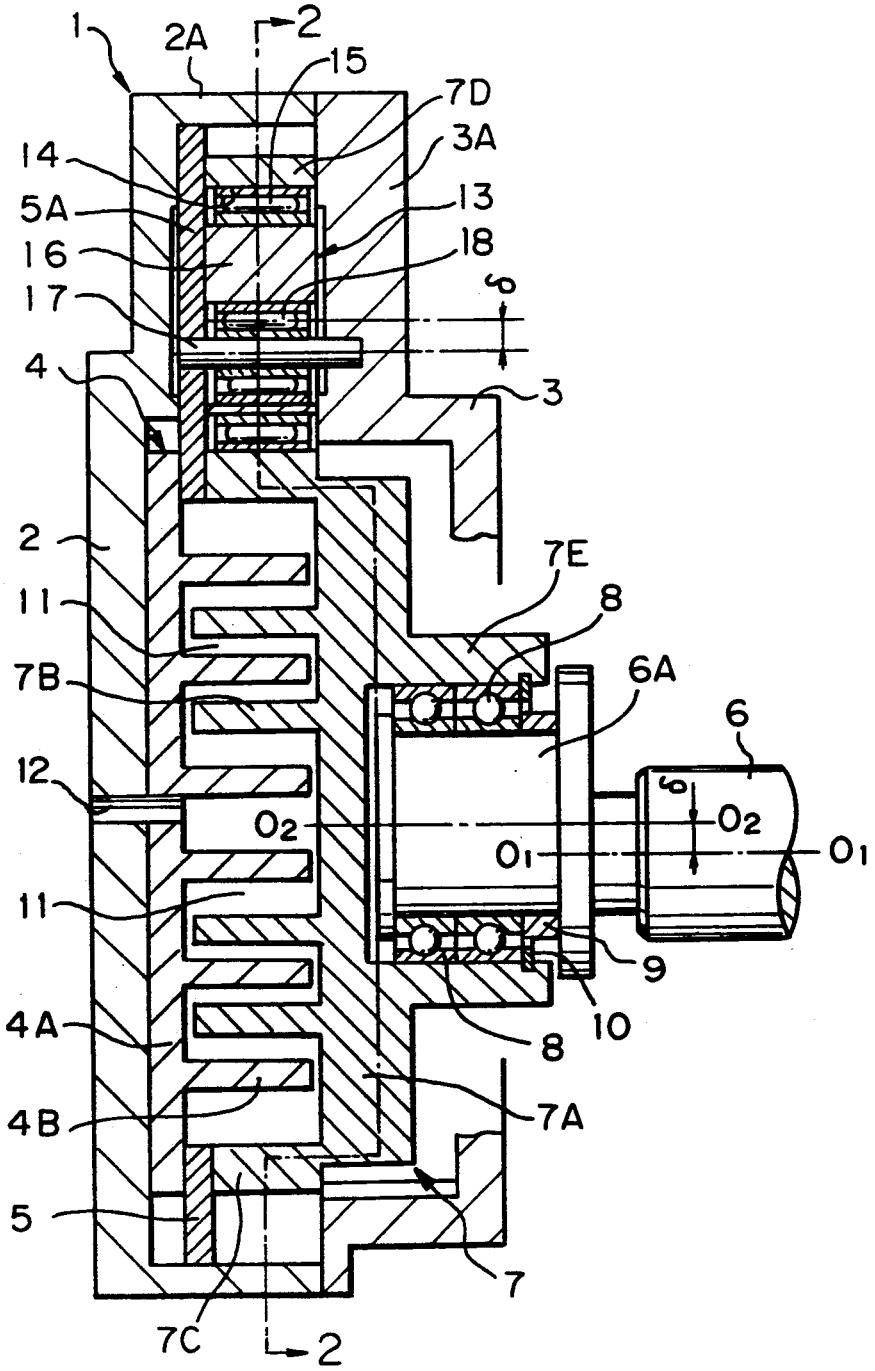
FIG. 1 is a longitudinal sectional view of a scroll compressor in a first embodiment according to the present invention.
Figure 2:
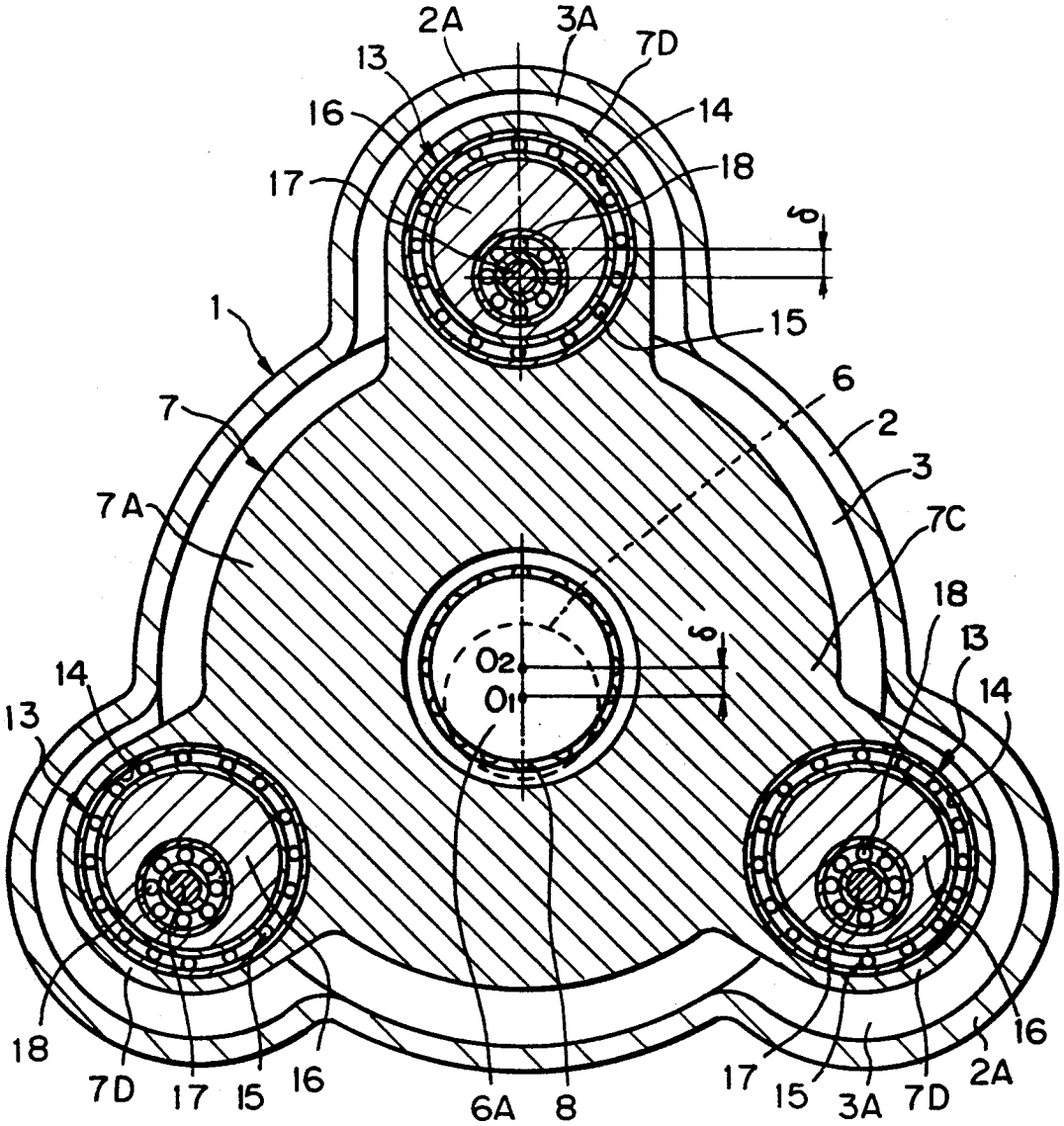
FIG. 2 is a sectional view taken on line 2—2 in FIG. 1.

First Embodiment (FIGS. 1 and 2)

Referring to FIGS. 1 and 2, a casing 1 consists, essentially, of a casing body 2 having a closed bottom cylinder, and a cover plate 3 covering the open end of the casing body 2. The casing body 2 and the cover plate 3 are provided respectively with three semicircular protrusions 2A and three semicircular protrusions 3A covering the semicircular protrusions 2A. As shown in FIG. 2, the semicircular protrusions 2A and 3A are arranged at equal angular intervals. The projections 7D of an orbiting scroll member 7 are housed for sliding motion respectively in the semicircular protrusions 2A.

A stationary scroll member 4 is fixed to the bottom of the casing body 2. The stationary scroll member 4 consists of a circular plate 4A and a scroll wrap 4B formed on the inner surface of the circular plate 4A. The scroll wrap 4B has the shape of an involute or an approximate involute. A support plate 5 is fixed to the bottom of the casing body 2. The support plate 5 is provided with three supporting portions 5A (only one of them is shown) having a shape substantially corresponding to that of the protrusions 2A of the casing body 2 and placed respectively in the protrusions 2A. The inner periphery of the support plate 5 overlaps the outer periphery of the plate 4A of the scroll member 4.

A drive shaft 6 is journalled for rotation about an axis $0_1$—$0_1$ on the cover plate 3 of the casing 1. The drive shaft 6 has an outer end projecting from the casing 1 and connected to a motor, not shown, or the like for driving the drive shaft 6, and an inner end provided with a crank 6A having the shape of a circular cylinder. The axis $0_2$—$0_2$ of the crank 6A deviates from the axis $0_1$—$0_1$ by an eccentricity $\delta$.

An orbiting scroll member 7 is supported on bearings 8 fitted on the crank 6A. The orbiting scroll member 7 consists, essentially, of a circular plate 7A, a scroll wrap 7B formed on the inner surface of the plate 7A similarly to the scroll wrap 4B of the stationary scroll member 4, a circular circumferential wall 7C formed integrally with the plate 7A along the circumference of the plate 7A so as to enclose the scroll wrap 7B, three protrusions 7D (FIG. 2) protruding radially outward from the circular wall 7C and slidably received between the protrusions 3A of the cover plate 3 and the supporting portions 5A of the support plate 5, respectively, and a cylindrical boss 7E projecting from the reverse side of the plate 7A and disposed on the bearings 8 mounted on the crank 6A. The end surface of the circular circumferential wall 7C is in sliding contact with the support plate 5.

The bearings 8 are prelubricated sealed bearings. A spacer 9 is placed between the bearings 8 and flange of the crank 6A. The orbiting scroll member 7 is held in place on the crank 6A with a snap ring 10. The scroll wrap 4A of the stationary scroll member 4 and the scroll wrap 7A of the orbiting scroll member 7 are combined with a predetermined phase difference so as to define a plurality of compression chambers 11. A discharge port 12 is formed through the plate 4A of the stationary scroll member 4 and the bottom wall of the casing body 2 so as to open into the radially innermost compression chamber 11. A suction port, not shown, is formed through the casing body 2 near the outer circumference of the stationary scroll member 4 and air sucked through the suction port is compressed in the compression chambers 11 and the compressed air is discharged outside through the discharge port 12.

A restraining mechanism 13 for restraining the orbit scroll member 7 from rotating about its own axis is provided between the casing 1 and the orbiting scroll member 7. The restraining mechanism 13 comprises bearings 15 fitted respectively in circular guide holes 14 formed in the protrusions 7D of the revolving scroll member 7, eccentric disks 16 supported respectively in the bearings 15, bearings 18 fitted respectively in the eccentric disks 16, and support shafts 17 supported respectively in the bearings 18 and each supported at their opposite ends on the protrusion 3A of the cover plate 3 and the supporting portion 5A of the support plate 5. The bearings 15 and 18 are prelubricated sealed bearings.

The center axis of each support shaft 17 of the restraining mechanism 13 is offset from the center axes of the guide hole 14 and the eccentric disk 16 by a predetermined eccentricity $\delta$ corresponding to the eccentricity $\delta$ of the crank 6A to enable the scroll member 7 to move along a circular orbit of a radius equal to the eccentricity $\delta$. When the orbiting scroll member 7 is driven by the crank 6A, the bearings 15 and 18 allow each eccentric disk 16 to rotate on the support shaft 17 to cause the orbiting scroll member 7 to orbit about the axis $0_1$—$0_1$ without rotating about the axis $0_2$—$0_2$.

Basically, the operation of the scroll compressor thus constructed is the same as that of the conventional scroll compressor. However, the restraining mechanism 13 incorporated into the scroll compressor in this embodiment, instead of the Oldham coupling employed in the conventional scroll compressor, to restrain the orbiting scroll member 7 from rotating about its own axis, the prelubricated sealed bearings 15 and 18, and the support shafts 17 each supported at their opposite ends by the support plate 5 and the cover plate 3 of the casing 1 enable the smooth, stable orbiting movement of the orbiting scroll member 7 relative to the stationary scroll member 4 without requiring lubrication. The support plate 5 enables the scroll compressor to form a compact struction including the casing 1 and the stationary scroll member 4 each having a relatively small size.

Figure 3:
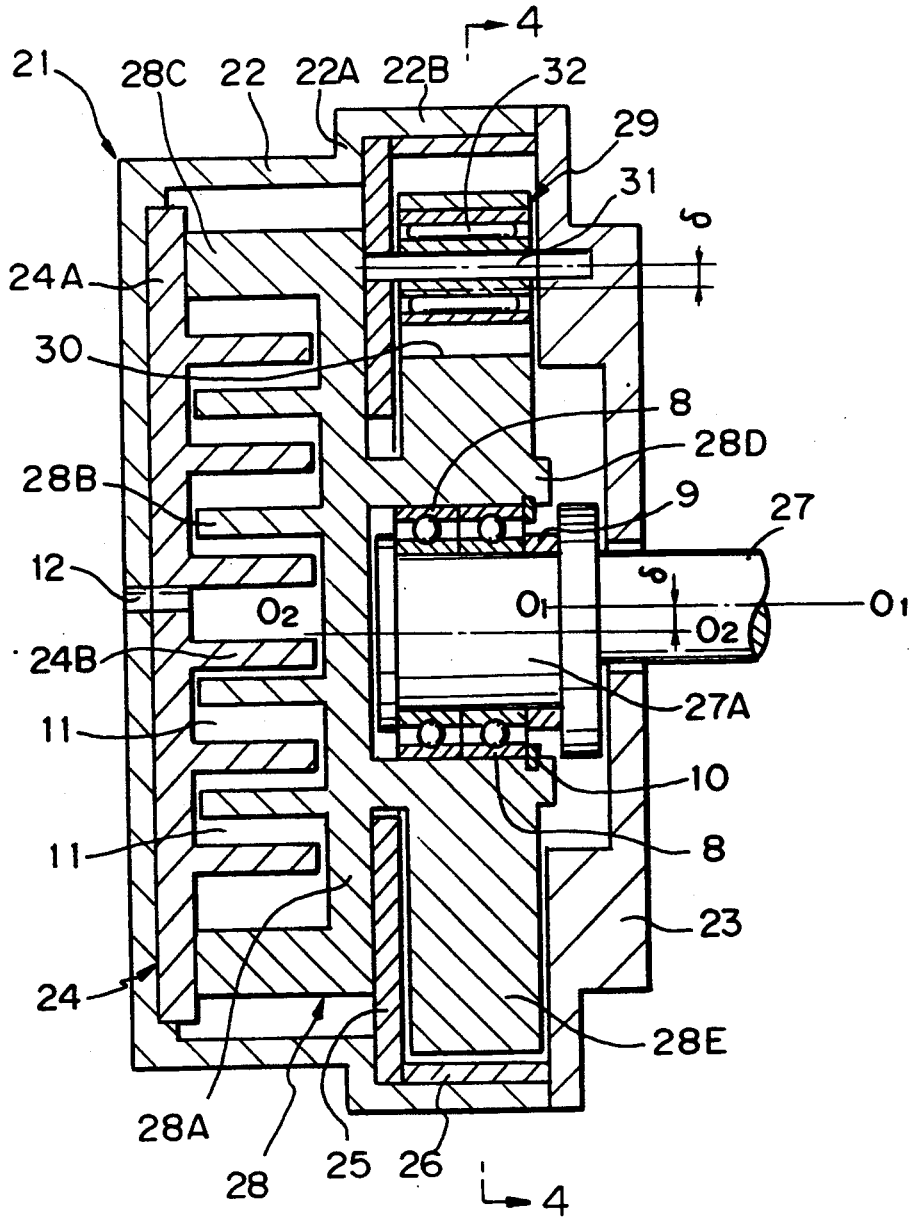
FIG. 3 is a longitudinal sectional view of a scroll compressor in a second embodiment according to the present invention.
Figure 4:
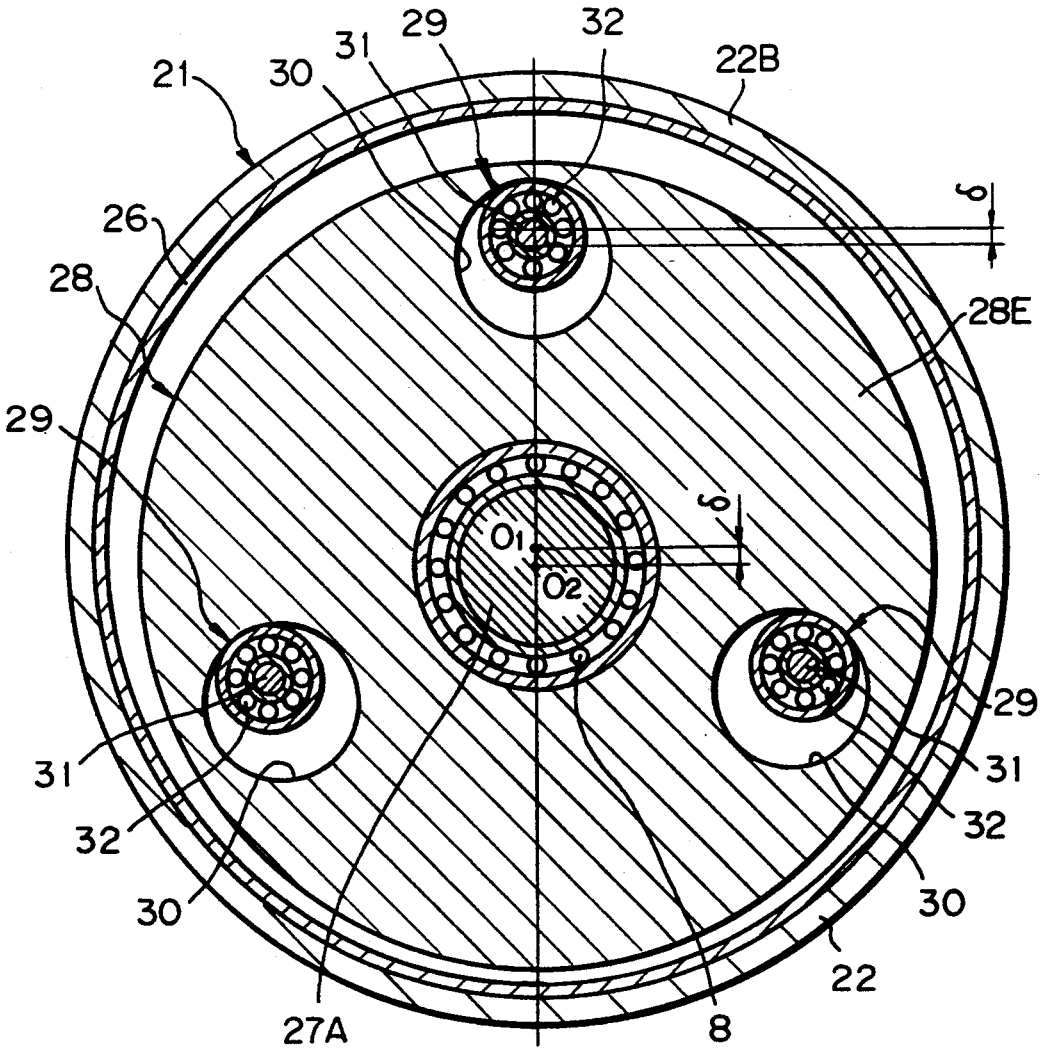
FIG. 4 is a sectional view taken on line 4—4 in FIG. 3.

Second Embodiment (FIGS. 3 and 4)

A scroll compressor in a second embodiment according to the present invention will be described hereinafter with reference to FIGS. 3 and 4, in which parts like or corresponding to those of the scroll compressor in the first embodiment are denoted by the same reference characters and a detailed description thereof will be omitted.

The scroll compressor in the second embodiment is featured by a restraining mechanism disposed within a casing behind the plate of an orbiting scroll member.

Referring to FIGS. 3 and 4, a casing 21 consists, essentially, of a casing body 22 having the shape of a cylinder with a closed bottom and an expanded open end 22B having a shoulder 22A, and a cover plate 23 covering the expanded open end 22B. A stationary scroll member 24, which is similar to the stationary scroll member 4 of the first embodiment, consists of a plate 24A and a scroll wrap 24B. A support plate 25 is fixed to the shoulder 22A of the casing body 22 with a holding ring 26. The holding ring 26 may be replaced by a plurality of plates. The support plate 25 is a comparatively thick, annular plate and is a member of the casing 21. The outside diameter of the support plate 25 corresponds to the inside diameter of the expanded open end 22B so that the support plate 25 is fitted closely in the expanded open end 22B.

A drive shaft 27 is provided on its inner end with a crank 27A. An orbiting scroll member 28 consists of a plate 28A, a scroll wrap 28B, a circular circumferential wall 28C and a boss 28D. The end surface of the circular circumferential wall 28C is in sliding contact with the inner surface of the plate 24A of the stationary scroll member 24. The boss 28D is provided with a relatively thick outer flange 28E located between the cover plate 23 and the support plate 25 within the expanded open end 22B.

As shown in FIG. 4, the restraining mechanism 29 for restraining the scroll member 28 from rotating about its own axis comprises the flange 28E provided with circular guide holes 30 formed at equal angular intervals, support shafts 31 passed axially through the guide holes 30, each having an axis offset from the center of the guide hole 30 by a predetermined eccentricity δ and having opposite ends supported respectively on the cover plate 23 and the support plate 25, and prelubricated sealed bearings 32 mounted respectively on the support shafts 31 in rolling contact respectively with the inner surfaces of the flange 28 defining the guide holes 30.

The bearings 32 in rolling contact with the respective surfaces defining the corresponding guide holes 30 restrain the orbiting scroll member 28 from rotating about its own axis.

Figure 5:
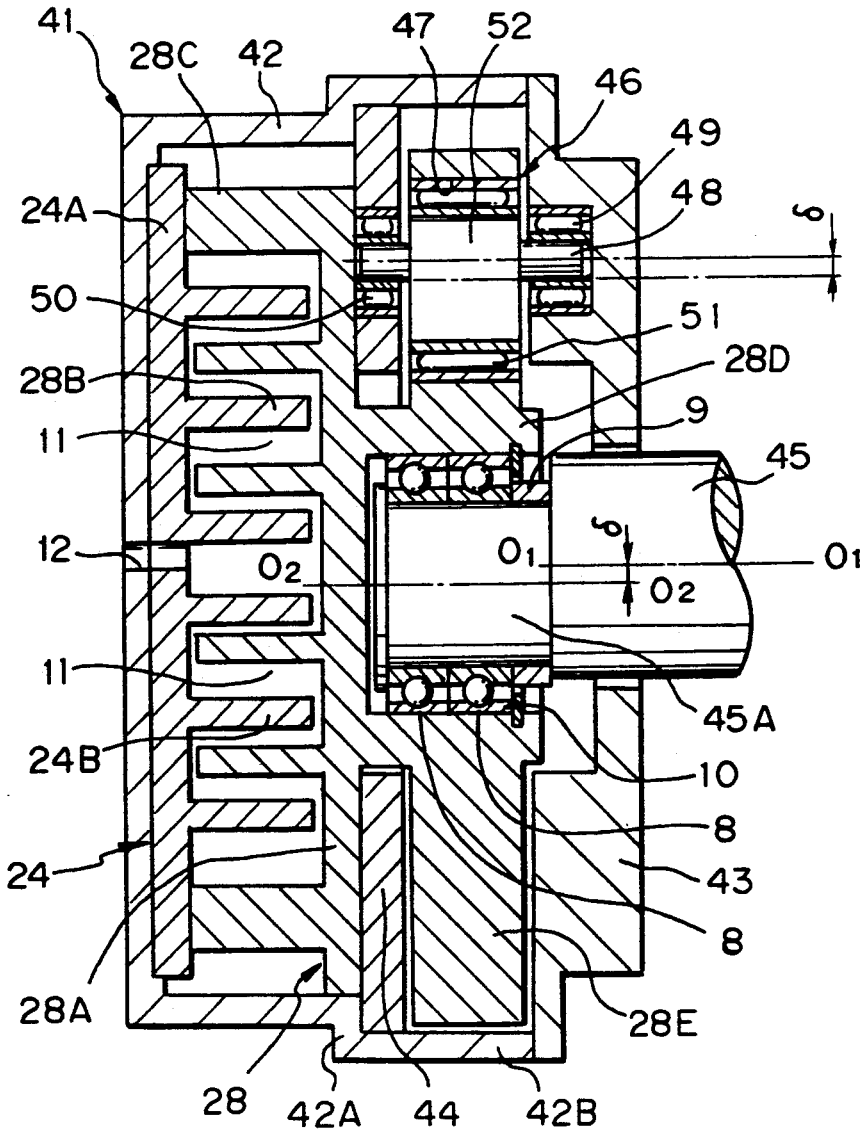
FIG. 5 is a longitudinal sectional view of a scroll compressor in a third embodiment according to the present invention.

Third Embodiment (FIG. 5)

A scroll compressor in a third embodiment according to the present invention will be described hereinafter with reference to FIG. 5, in which parts the same as or corresponding to those of the scroll compressor in the second embodiment are denoted by the same reference characters with a detailed description thereof being omitted.

The scroll compressor in the third embodiment is featured by a restraining mechanism including support shafts integrally provided each with an eccentric cam supported in a bearing fitted in a guide hole.

Referring to FIG. 5, a casing 41 has substantially the same structure as the casing 21 of the second embodiment. The casing consists, essentially, of a casing body 42 having an expanded open end 42B and a shoulder 42A, and a cover plate 43. A stationary scroll member 24 is fixed to the bottom of the casing body 42. A support plate 44 is fitted in the expanded open end 42B and is fixed to the shoulder 42A. The support plate 44 is a comparatively thick, annular plate substantially similar to the support plate 25 of the second embodiment and is a component of the casing 41. The surface of the support plate 44 facing the bottom of the casing body 42 is in sliding contact with the reverse side of the plate 28A of an orbiting scroll member 28.

A drive shaft 45, which is substantially similar in shape to the drive shaft 27 of the second embodiment, is provided on its inner end with a crank 45A. A restraining mechanism 46 is substantially similar to the restraining mechanism 29 of the second embodiment. The restraining mechanism 46 comprises the flange 28E of the revolving scroll member 28 provided with guide holes 47, support shafts 48 integrally provided in their middle portions respectively with eccentric cams 52, bearings 51 supporting the eccentric cams 52 in the guide holes 47, respectively, bearings 49 each supporting one end of the support shaft 48 on the cover plate 43, and bearings 50 each supporting the other end of the support shaft on the annular plate 44. The center axis of each eccentric cam 52 is offset from the center axis of the support shaft 48 by an eccentricity δ. The eccentric cam 52 is coaxial with the guide hole 47.

The flange 28E of the boss 28D of the orbiting scroll member 28 employed in the second and third embodiments may be replaced by three protrusions, which are similar to the protrusions 7D of the first embodiment, protruding from the boss 28D, arranged at angularly equal intervals, and provided each with the guide hole 47.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A scroll type fluid apparatus comprising:

a casing including a casing body forming a bottom portion thereof, and a support plate fixed to said casing body;

a stationary scroll member discrete from said casing and fixed to the casing body forming the bottom portion of said casing, said stationary scroll member including a plate and a scroll wrap extending from a major surface of said plate;

a drive shaft journaled on the casing and including a crank at an inner end thereof located within the casing;

an orbiting scroll member journaled on the crank of said drive shaft, said orbiting scroll member including a plate and a scroll wrap extending from a major surface of the plate thereof, the scroll wrap of said orbiting scroll member forming a sealed space of a variable volume in cooperation with the scroll wrap of said stationary scroll member;

said support plate having opposite side surfaces, one of said opposite side surfaces resting on said casing body, and the other of said opposite side surfaces being in sliding contact with said orbiting scroll member, said support plate being interposed between said orbiting and said stationary scroll members thereby fixing said stationary scroll member to said casing body; and restraining means for restraining the orbiting scroll member from rotating about its own axis, said restraining means comprising a plurality of guides arranged at angular intervals along the circumference of said orbiting scroll member, a plurality of support shafts each extending axially through a respective one of said guides with its axis offset from the axial center of the respective guide by a predetermined distance and each having opposite ends fixed in position relative to said casing, and a plurality of bearings each mounted on a respective one of said support shafts and rotatably supporting the respective support shaft in the guide through which the respective support shaft extends.

2. A scroll type fluid apparatus according to claim 1, and further comprising a respective bearing fitted in each of said guides, and a respective eccentric member supported in each said respective bearing, and wherein each of said support shafts with a said bearing mounted thereon is eccentrically fitted in a said eccentric member.

3. A scroll type fluid apparatus according to claim 1, wherein said orbiting scroll member has an outer circumferential wall extending upright from the plate thereof, said wall being in sliding contact with said support plate.

4. A scroll type fluid apparatus according to claim 1, wherein one of the ends of each of said support shafts is supported in said support plate.

5. A scroll type fluid apparatus according to claim 1, wherein movement of said support plate in the radial direction is restricted by an inner peripheral wall of said casing.

6. A scroll type fluid apparatus according to claim 1, wherein the orbiting scroll member has a plurality of radial protrusions corresponding in number to the number of said guides, and said guides of the restraining means are provided, respectively, at the radial protrusions.

7. A scroll type fluid apparatus according to claim 6, and further comprising a respective bearing fitted in each of said guides, and a respective eccentric member supported in each said respective bearing, and wherein each of said support shafts with a said bearing mounted thereon is eccentrically fitted in a said eccentric member.

8. A scroll type fluid apparatus according to claim 6, wherein said support plate is provided with a plurality of radial protrusions corresponding in number to the number of said protrusions of the orbiting scroll member.

* * * * *